United States Patent [19]

Ezis et al.

[11] 4,217,320

[45] * Aug. 12, 1980

[54] SLIP CAST ARTICLE MANUFACTURING METHOD

[75] Inventors: Andre Ezis, Grosse Ile; John M. Nicholson, Wayne, both of Mich.

[73] Assignee: Ford Motor Company, Dearborn, Mich.

[ * ] Notice: The portion of the term of this patent subsequent to Jan. 10, 1995, has been disclaimed.

[21] Appl. No.: 753,345

[22] Filed: Dec. 22, 1976

[51] Int. Cl.[2] ..... B28B 1/26

[52] U.S. Cl. ..... 264/65; 264/86; 264/221; 264/317

[58] Field of Search ..... 264/86, 221, 317, 65, 264/85

[56] References Cited

U.S. PATENT DOCUMENTS

| | | | |
|---|---|---|---|
| 3,263,957 | 8/1966 | Lirones | 264/86 |
| 3,339,622 | 9/1967 | Horton | 264/221 |
| 3,420,644 | 1/1969 | Lirones | 264/221 |
| 3,888,662 | 6/1975 | Boeckeler | 264/317 |
| 4,011,291 | 3/1977 | Curry | 264/86 |
| 4,067,943 | 1/1978 | Etis et al. | 264/86 |

FOREIGN PATENT DOCUMENTS

| | | | |
|---|---|---|---|
| 779474 | 7/1957 | United Kingdom | 264/86 |

*Primary Examiner*—John A. Parrish
*Attorney, Agent, or Firm*—William E. Johnson; Keith L. Zerschling

[57] ABSTRACT

A method of forming a slip cast article is disclosed. The slip cast article is formed in a casting volume of a forming mold, which mold has a portion thereof formed of a meltable organic material. The vehicle of the casting slip used to form the article is drawn off to a level which provides a consolidated casting in the casting volume which contains sufficient vehicle that the casting is resistant to shrinkage. The consolidated casting and the organic mold portion are then surrounded with a porous, liquid drawing media. A high humidity of the vehicle of the casting slip is maintained about the consolidated casting surrounded by the porous, liquid drawing media. The consolidated casting and surrounding liquid drawing media are heated while the high humidity of the vehicle is maintained to a temperature which causes the meltable organic material to melt. The porous, liquid drawing media then draws the melted material away from the consolidated casting. After the meltable mold portion has been withdrawn from association with the consolidated casting, the high humidity vehicle is removed from association with the consolidated casting and the casting is permitted to dry.

6 Claims, 10 Drawing Figures

FIG. 6
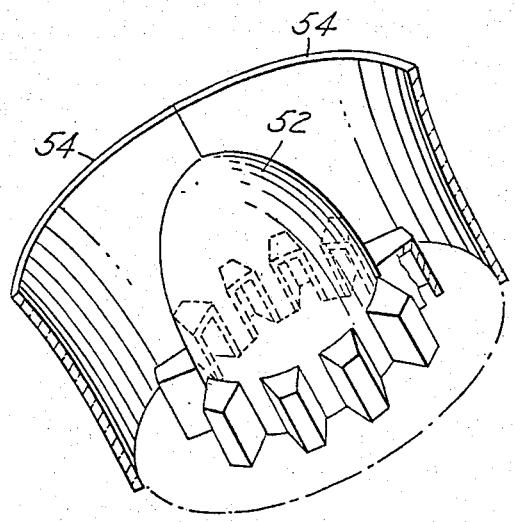
FIG. 7
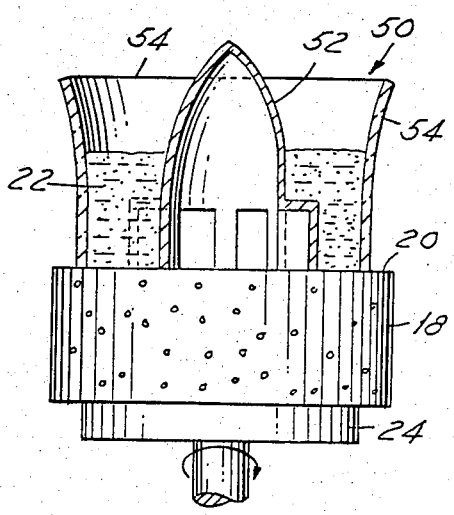
FIG. 8
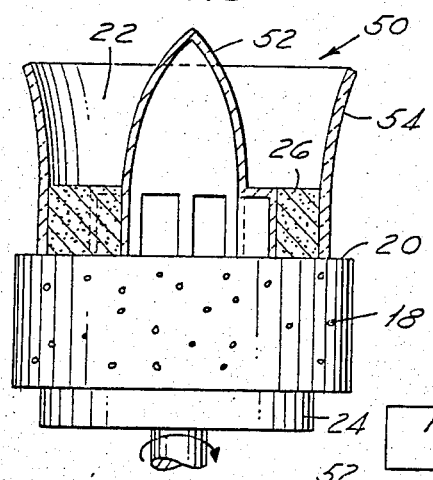
FIG. 10
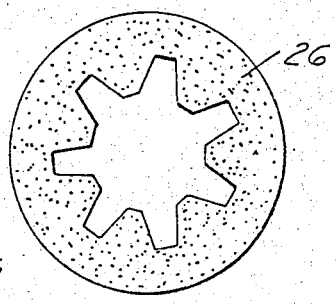
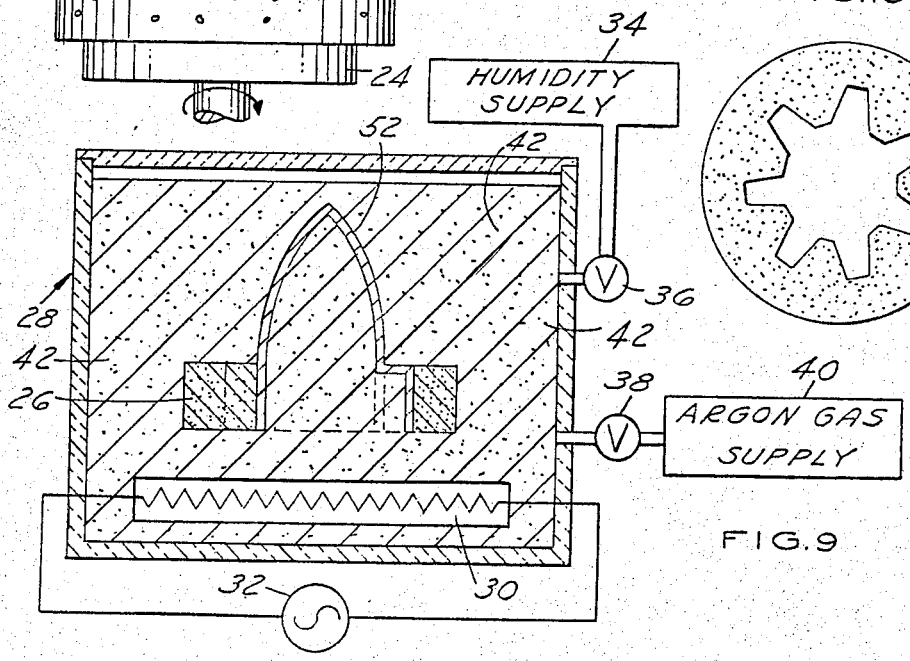
FIG. 9

SLIP CAST ARTICLE MANUFACTURING METHOD

The invention herein described was made in the course of or under a contract or subcontract thereunder with the Department of the Army. (DAAG-46-71-C-0162)

BACKGROUND OF THE INVENTION

Slip casting is an ancient art. Generally in this art, a ceramic material suspended in a vehicle is poured into a mold. The vehicle is drawn out of the casting slip and a consolidated casting is left behind in the mold. The mold is then removed from the consolidated casting and the consolidated casting processed to produce the final properties desired in the casting.

We believe we have developed a unique procedure for forming a consolidated casting in the mold and thereafter removing the mold without damaging the casting. This procedure is particularly useful if the casting to be formed is one which has a delicate shape or a complex surface configuration.

The process we teach herein is one which may be used to produce consolidated castings in which the surface shape is very sophisticated and/or highly complex. For example, we are able to manufacture rotors for gas turbine engines using this process. As is well known in the art, such rotors have blades extending from a hub portion, which blades are very complex in surface geometry. Such blade configurations are extremely expensive to manufacture if machined from a single, solid piece of material.

It is a principal object of our invention to provide a method for manufacturing slip cast articles of complex configuration. It is a further object of our invention to provide such a manufacturing method which is relatively easy to carry out but produces complex castings very economically.

SUMMARY OF THE INVENTION

This invention is directed to a method of forming a slip cast article, and more particularly, to a method of forming a slip cast article in which the final article has a complex surface configuration.

In accordance with the teachings of this invention, a slip cast article is formed by the following procedure. A first mold portion for defining a mold cavity is formed from a meltable organic material which (a) is readily formable to the negative of the surface area of complex shape, (b) is nonreactive with the material contained in the vehicle of the casting slip to be used to form the article, and (c) provides a smooth pore-free surface that the slip can be cast against. Other mold portions required to define the rest of the surface area of the article to be slip cast are also formed. The meltable mold portion and the required mold portions are assembled with a slip vehicle drawing mold portion. In their assembled condition, these elements form a casting volume which defines the shape of the article to be cast. At least one surface of the casting volume is formed by the vehicle drawing mold portion.

A slip including a vehicle and a casting material is poured into the casting volume. The first mold portion and any of the other required mold portions are disassembled from the slip vehicle drawing mold portion when the vehicle of the slip has been reduced to a level which provides for a consolidated casting in the casting volume and also provides sufficient vehicle in the consolidated casting that the casting is resistant to shrinkage. Any of the other required mold portions that are disassembable may be disassembled from the consolidated casting.

The consolidated casting containing the sufficient vehicle with the first mold portion attached thereto is surrounded with a porous, liquid drawing media, such as a refractory ceramic powder. A high humidity of the vehicle of the casting slip is maintained about the consolidated casting which is surrounded by the porous, liquid drawing media. The consolidated casting and surrounding porous, liquid drawing media are heated while the high humidity of the vehicle is maintained. The heating is to a temperature which causes the meltable organic material forming the first mold portion to melt. As the mold portion melts, the porous, liquid drawing media draws the melted material away from the consolidated casting. After the first mold portion has been melted and withdrawn from association with the consolidated casting, the high humidity of the vehicle is removed from association with the consolidated casting. Thereafter, the consolidated casting is dried to form the slip cast article.

BRIEF DESCRIPTION OF THE DRAWINGS

FIGS. 6 through 10 are similar to FIGS. 1 through 5 but illustrate the manufacture of an article having internal rather than external teeth.

DESCRIPTION OF THE PREFERRED EMBODIMENT

Figure 1:
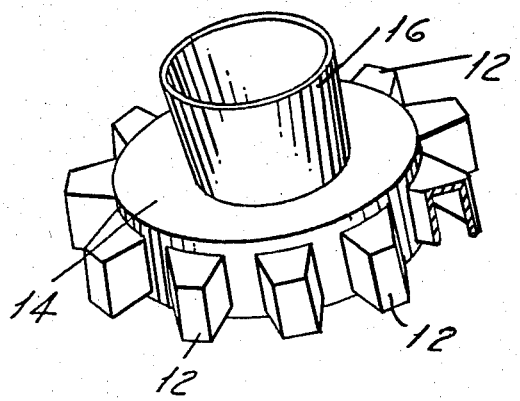
FIG. 1 is a perspective view of a mold member which defines the shape of the article to be formed.

In FIG. 1 there is seen a mold, for forming a slip cast article. The mold is made from a meltable organic material which is readily formable to the negative to the shape of the article to be cast. The organic material also should be a material which is nonreactive with the casting material to be cast therein and nonreactive with the vehicle carrying material to be cast therein. The organic material forming the mold also should provide a smooth, pore-free surface that the article can be formed against.

The mold is hollow on the inside. The mold has a plurality of teeth forming elements 12 attached to a hub forming element 14. The mold also has a riser portion 16, the purpose of which will be disclosed herein below. Also, the mold is open across its bottom.

The mold may be made from an organic material such as a wax. This wax is formed into the shape of the mold by a process such as the following. A mandrel representing the shape of the gear to be cast is formed from a wax, such as a water soluble wax which is dissolvable in a dilute acid solution. The material to form the mold, in this case a 124° F. melting point ethylene derived hydrocarbon polymer (trade name Vybar 260 sold by the Petrolite Corporation) is liquified and maintained at a temperature of about 170° F. The water soluble wax pattern is dipped in the liquified ethylene polymer several times to form a coating of suitable thickness. A thickness of 50 mils is generally sufficient. This process forms the organic material mold having the complex shape of a ring gear. When the ethylene polymer on the mandrel is solidified, the mandrel is removed by dissolving it in a water-hydrochloric acid solution leaving behind only the mold which now can be used to form an article in a slip casting operation.

In the preferred embodiment, the mold is a one-piece unit. However, it is within the scope of this invention to use a mold which has the meltable mold portion formed of organic material as only a portion of the total mold. For example, two or more mold portions may be used in conjunction with each other in the shaping of the article. These mold portions could all be made of the meltable material if desired.

On the other hand, others of the mold portions required to define the shape of the article to be slip cast may be made from other materials such as ordinary plaster used in slip casting operations. For example, if the part to be fabricated was a ring gear with the teeth on the interior thereof, the complex shape to define the interior teeth could be made from the organic material and the outer circumference of the gear could have its surface defined by sectional mold portions. This particular process will be described when FIGS. 6 through 10 are discussed. Such sectional mold portions could be made from either a multiple organic member or from pottery plaster as dictated by the shape of the article.

If all of a sectional mold is made from a meltable material, the mold would be treated exactly like the mold as will be more fully discussed hereinbelow. If the sectional mold portions are made of pottery plaster, they may be carried along with the mold or they may be removed from association with the mold after a slip casting operation. The remaining discussion in this specification will center about a single mold but the invention herein described covers the utilization of more than one mold member and having the plurality of mold members which may be made either from the meltable organic material or from plaster or other suitable mold defining materials.

Figure 2:
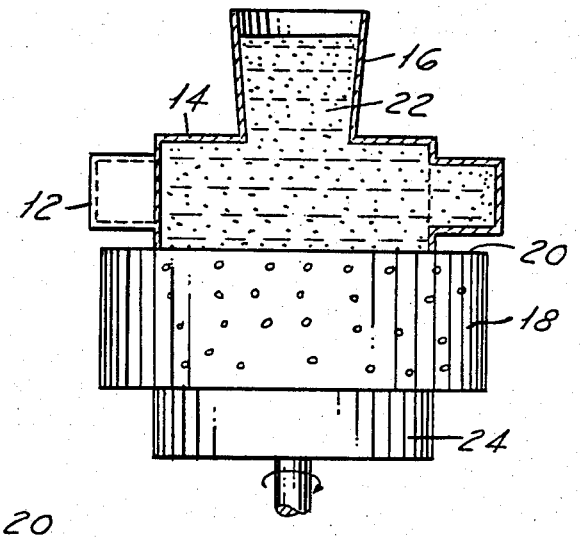
FIG. 2 is a schematical representation of the casting of an article at the beginning of the casting operation.

As best seen in FIG. 2, the mold is placed on a slip vehicle drawing mold portion 18. This mold portion may be made from ordinary pottery plaster as is well known in the art. An upper surface 20 of the vehicle drawing mold portion defines a surface of a casting volume 22. As is well known in the art, the slip vehicle drawing mold portion 18 draws a vehicle of a slip out of the casting volume 22 so that the casting operation may take place.

The slip vehicle drawing mold portion 18 rests on a rotatable table 24. This table is rotated during the casting operation so as to develop forces which aid in moving particles of casting material out into the tooth forming elements 12 of the mold. This type of centrifugal casting is well known to those skilled in the art.

A casting slip is prepared by suspending a casting material in a suitable vehicle therefor. The casting material may be any of the hundreds of materials known to those skilled in the art. The vehicle employed in suspending the casting material may be any vehicle which is compatible with the material to be cast. In the preferred embodiment to be described herein, the vehicle of the casting slip is water and the material suspended is silicon particles.

As mentioned above, in accordance with the disclosure of the preferred embodiment, a casting slip containing silicon particles and water will be the casting slip for casting into the casting volume 22 defined by the mold and the slip vehicle drawing mold 18. Agents such as nonionic flourochemical surfactants may be added to the slip to decrease its surface tension thereby insuring complete wetability of the slip with the organic mold portion. Full details of such a casting slip are described in U.S. patent application Ser. No. 415,898 entitled "Process for Making a Silicon Nitride Article" filed on Nov. 14, 1973 and assigned to the same assignee of this application. That application is hereby incorporated into this application by reference.

As best illustrated in FIG. 2, the casting slip is poured into the casting volume 22 and fills the casting volume to the top of the riser portion 16 of the mold. At the inception of the casting operation, the material of this slip is finally dispersed in the vehicle. This is represented in the finely dotted portion of FIG. 2. The rotatable table 24 is actuated and the mold and slip vehicle drawing mold portion are rotated. As rotation proceeds, the slip vehicle drawing mold portion 18 draws the vehicle, that is the water, out of the casting volume 22. This withdrawal of water takes place slowly over a period of time as is well known in the art.

Figure 3:
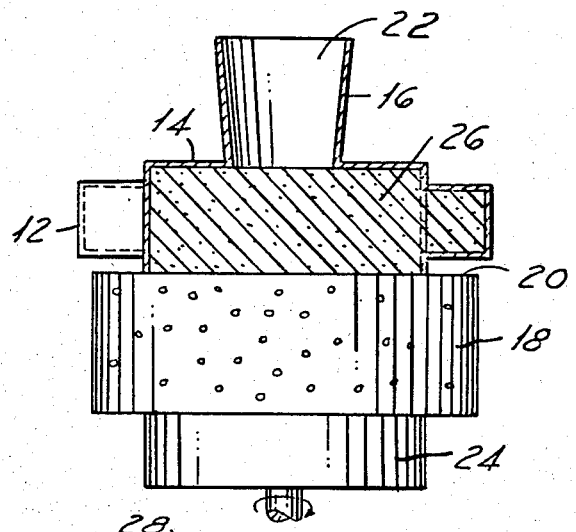
FIG. 3 is a schematical representation of the casting of an article near the end of the casting operation.

Reference is now made to FIG. 3. In this figure, the completion of the casting operation is illustrated. As the rotation of the rotatable table 24 has gone on, the vehicle of the slip has been withdrawn from the casting volume 22 leaving behind a consolidated casting 26. A small amount of slip material is still found on top of the consolidated casting. The slip vehicle drawing mold portion 18 is permitted to withdraw the vehicle of the slip until the slip in the casting volume has been reduced to a level which provides for a consolidated casting 26 in the casting volume and also provides sufficient vehicle in the consolidated casting that the consolidated casting is resistant to shrinkage. As is readily apparent, since the consolidated casting is formed from minute particles which are fitted against one another in a random fashion, the consolidated casting will be porous because the fit is not perfect.

It is necessary that the casting operation be terminated prior to a time at which the slip vehicle drawing mold portion 18 withdraws the water in the pores of the slip cast article. If the casting operation is permitted to go to that point at which the mold is withdrawing pore water, i.e., the water contained in the pores of the consolidated casting, the casting will begin to shrink in the mold and will crack. Therefore, the slip casting operation is terminated at a point which provides sufficient water in the consolidated casting and that casting is then resistant to shrinkage. The water provided in the casting is not only in the form of water in the pores, but also is in the form of "hull" water which is water electronically bonded to the material being cast.

It should also be mentioned that one skilled in the art may easily recognize the time at which the slip vehicle drawing mold portion 18 is starting to withdraw pore water and hull water from the consolidated casting 26. This point is recognized because one can see the disappearance of all of the slip's vehicle from the top surface of the article being formed. Thus, an easy way for one skilled in the art to know when to terminate the casting operation would be when the slip vehicle forms only a very thin layer on the top of the consolidated casting.

After the casting operation, the consolidated casting 26 and mold are removed from the slip vehicle drawing mold portion 18. If the mold had been made of a plurality of elements and some of the mold elements were removable, they could now be removed from association with the consolidated article and the meltable mold portion prior to the next step in our method. On the other hand, one may leave such elements in association with the mentioned elements if they desire to do so.

The mold and the consolidated casting 26 contained therein are now deposited in a closable furnace 28. This furnace is equipped with an electrical heating element 30 connected to a suitable power source 32. The furnace also has associated therewith a humidity supply generator 34. This generator may be connected to the furnace through a valve 36. A valve 38 connects an argon supply source 40 to the furnace.

The closable furnace 28 has a granular media 42 contained therein. This granular media establishes a porous network capable of wicking the meltable organic material away from the consolidated casting 26. In accordance with the preferred embodiment of this invention, bubble alumina is used as the granular media in the closable furnace. In accordance with the teachings of this invention, the mold and the consolidated casting 26 contained therewithin are removed from the slip vehicle mold portion 18 while sufficient water is contained in the casting to maintain its shape. While this condition still occurs, the consolidated casting and mold are placed in the closable furnace 28. The granular media 42 is then packed around the delicate portions of the structure and as shown in the figure and may be raised to a height above the casting and mold. Alternately, if the granular media is heavy and the molded article light, the media would only be packed up a portion of the sides of the article. While this operation is being carried out, the humidity supplied the generator 34 is supplying the evaporated form of the vehicle used in the slip casting operation in order to maintain a relatively high humidity of the vehicle in the furnace. This prevents the evaporation of the vehicle contained in the casting. In the case where the vehicle used was water, a relatively high humidity of water is maintained in the furnace in order to prevent the evaporation of hull water and pore water from the consolidated casting.

The electrical heating element 30 is actuated through the power source 32 in order to increase the temperature of the closable furnace 28 to a point at which the material forming the mold will be melted and wicked away. The humidity of the vehicle is maintained during this melting and wicking operation. In accordance with the preferred form of the invention, the humidity of the furnace is maintained at over 90 percent and the temperautre is maintained at 150° F. The meltable organic mold portion begins to liquify and the bubble alumina acts as a granular media removes the liquified organic by absorption into the media's available porosity. This process continues until the entire organic mold has been removed. In addition to absorbing the fluidized organic material, the bubble alumina also provides a mechanical support to the delicate portions of the casting during this processing. The humidity is controlled to a high level to prevent water evaporation from the casting which, in turn, inhibits shrinkage of the green casting. Excessive green shrinkage at this point must be avoided during removal of the mold so as to prevent tearing or cracking of the delicate portions of the casting against mold defining elements.

As an additional matter, the humidity may also contain a vaporized solvent which can assist in dissolving the wax.

Once the entire organic mold has been absorbed in the granular media, the temperature of the oven can be increased at a slow rate to a temperature of 600° F. The entire cycle generally takes about three days. The humidity of the oven's atmosphere is no longer controlled during this burn-out cycle. The purpose of this cycle is to remove all the moisture or vehicle in the casting and allow it to shrink unrestrained, and to burn off all the organic that resides in the pore structure of the granular media.

After the casting is dried and the wax burn-out complete, an optional process may take place. This optional process is one in which the argon supply source 40 is connected by valve 38 to the closable furnace 28 to supply an argon atmosphere thereto. The furnace is heated to a temperature of approximately 2000° F. for a period of three hours. This heat treatment imparts hardness to the casting to permit its handling.

Figure 5:
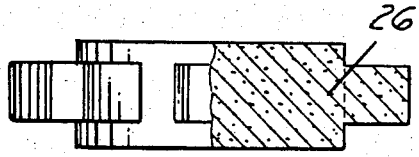
FIG. 5 is a schematical representation of the article produced by the method of this invention.
Figure 4:
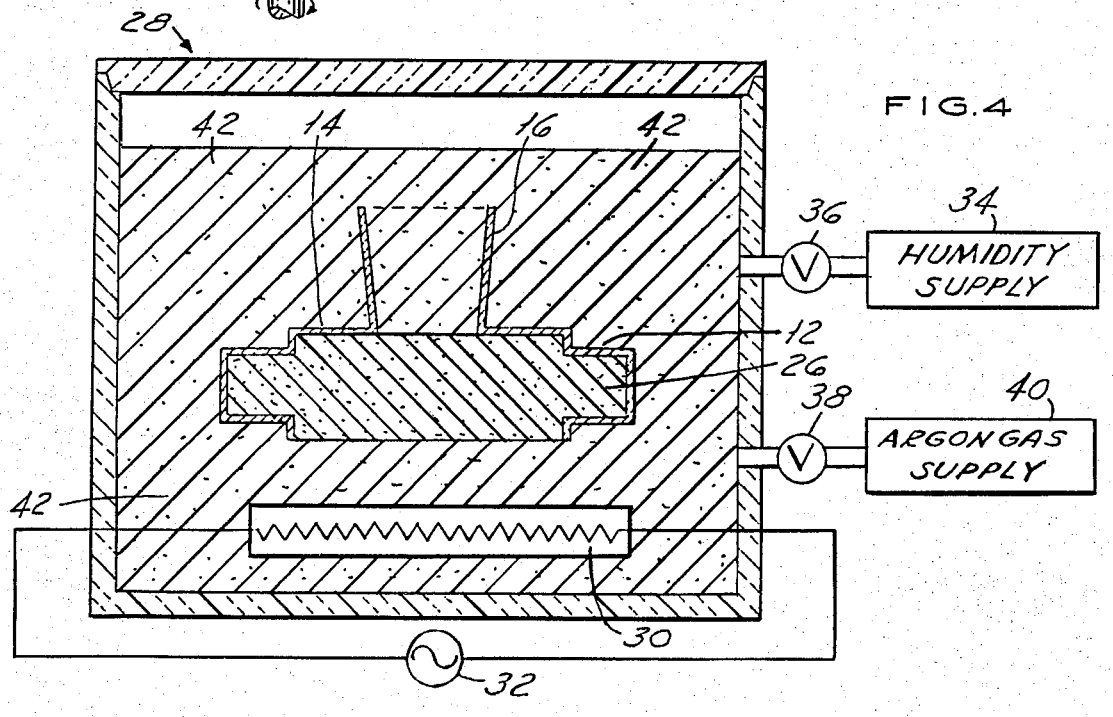
FIG. 4 is a schematical representation of the manner in which a meltable mold member is removed from the cast article.

Once the furnace 28 has been cooled to room temperature, the final casting 26 can be recovered as is illustrated in FIG. 5.

In the specific example described herein, further processing steps are carried out on the article 26 in order to change the silicon particles into silicon nitride. The nitriding is carried out by exposing the heated article to nitrogen gas at temperatures and for periods of time that the silicon is transformed into silicon nitride. A full procedure for nitriding silicon to form silicon nitride is disclosed in British Pat. No. 717,555.

Reference is now made to FIGS. 6 through 10 in which like numbers designate similar parts. In this situation, the article to be formed is one which has internal gear teeth rather than external teeth. The only difference in the process is the change in configuration of the mold. In this case, the mold is generally designated by the numeral 50. The mold has a first meltable mold portion 52 which defines the complex internal teeth to be formed on the final article. An outer mold portion is defined by several mold sections 54 which are made of ordinary pottery plaster.

The mold 50 formed from its mold portions 52 and 54 are assembled on the vehicle drawing mold portion 18 as is illustrated in FIG. 7. The processing for the rest of the material is the same as it was for processing to produce the part 26. In this case, however, prior to placing the consolidated casting and the first meltable mold portion 52 in the closable furnace 28, the mold portion 54 formed of the pottery plaster may be removed from association with the consolidated casting and the first mold portion. Thereafter, the treatment in the furnace is the same as previously described for the first example. The final result is a finished article 56 such as shown in FIG. 10.

There has been disclosed herein a method of manufacturing slip cast articles. In view of the teachings of the specification, those skilled in the art will have modifications thereof which fall within the true spirit and scope of this invention. It is intended that all such modifications be included within the scope of the appended claims.

We claim:

1. A method of forming a slip cast article wherein the article has at least one surface area of complex shape, which method comprises the following steps:

forming a first mold portion which will form the surface area of complex shape from a meltable organic material which (a) is readily formable to the negative to the surface area of complex shape, (b) is nonreactive with the material contained in the vehicle of the casting slip to be used to form the article, and (c) provides a smooth pore free surface that the slip can be cast against;

forming other mold portions required to define any noncomplex surfaces of the article to be slip cast;

assembling said first mold portion and any of said other mold portions with a slip vehicle drawing mold portion so that said first mold portion, said other required mold portions and said slip vehicle drawing mold portion define a casting volume which has at least one surface formed by said slip vehicle drawing mold portion;

poring a slip which includes a vehicle and a casting material into said casting volume;

disassembling said first mold portion and any of said other required mold portions from said slip vehicle drawing mold portion when said vehicle of said slip has been reduced to a level which provides for a consolidated casting of said casting material in said casting volume and also provides sufficient vehicle in said consolidated casting that the consolidated casting is resistant to shrinkage;

disassembling any of said other required mold portions which are disassembable from said consolidated casting containing said sufficient vehicle;

engaging at least a portion of said consolidated casting containing said sufficient vehicle with said first mold portion attached thereto with a porous, liquid drawing media;

maintaining a high humidity of said vehicle of said casting slip about said consolidated casting engaged by said porous, liquid drawing media;

heating said consolidated casting and engaging porous, liquid drawing media while said high humidity of said vehicle is maintained to a temperature which causes said meltable organic material forming said first mold portion to melt, said porous, liquid drawing media drawing the melted material away from said consolidated casting;

after said first mold portion has been melted and withdrawn from association with said consolidated casting, removing the high humidity vehicle from association with the consolidated casting; and drying said consolidated casting to form a slip cast article.

2. The method of claim 1 wherein: said vehicle for said casting slip is water.

3. The method of claim 1 wherein: after said consolidated casting has been dried, the following step is carried out thereon: argon sintering said consolidated casting while supported in said porous, liquid drawing media.

4. The method of claim 1 wherein: only said first mold portion is used in conjunction with said vehicle drawing mold portion.

5. The method of claim 1 wherein: said other required mold portions are formed of the same material as said first mold portion and wherein said other mold portions are not disassembled from said consolidated casting but rather are processed and removed as is the first mold portion.

6. The method of claim 1 wherein: the high humidity of the vehicle also contains vaporized solvent for said first mold portion.

* * * * *